US006001522A

United States Patent [19]

Woo et al.

[11] Patent Number: 6,001,522

[45] Date of Patent: Dec. 14, 1999

[54] BARRIER LAYER FOR PHOTOCONDUCTOR ELEMENTS COMPRISING AN ORGANIC POLYMER AND SILICA

[75] Inventors: Edward J. Woo; David R. Boston, both of Woodbury, Minn.

[73] Assignee: Imation Corp., Oakdale, Minn.

[21] Appl. No.: 08/091,999

[22] Filed: Jul. 15, 1993

[51] Int. Cl.[6] ..... G03G 5/14

[52] U.S. Cl. ..... 430/65; 430/67

[58] Field of Search ..... 430/64, 65, 67

[56] References Cited

U.S. PATENT DOCUMENTS

| | | | |
|---|---|---|---|
| 3,816,118 | 6/1974 | Byrne | 96/1.5 |
| 3,986,997 | 10/1976 | Clark | 260/29.2 |
| 4,027,073 | 5/1977 | Clark | 428/412 |
| 4,148,637 | 4/1979 | Kubota et al. | 430/66 |
| 4,439,509 | 3/1984 | Schank | 430/132 |
| 4,565,760 | 1/1986 | Schank | 430/66 |
| 4,595,602 | 6/1986 | Schank | 427/76 |
| 4,600,673 | 7/1986 | Hendrickson et al. | 430/66 |
| 4,606,934 | 8/1986 | Lee et al. | 427/76 |
| 4,647,521 | 3/1987 | Oguchi et al. | 430/66 X |
| 4,716,091 | 12/1987 | Yoshihara et al. | 430/66 |
| 4,752,549 | 6/1988 | Otsuka et al. | 430/64 X |
| 4,885,332 | 12/1989 | Bilkadi | 524/714 |
| 4,906,523 | 3/1990 | Bilkadi et al. | 428/327 |
| 4,912,000 | 3/1990 | Kumakura et al. | 430/67 |
| 4,923,775 | 5/1990 | Schank | 430/69 |
| 4,957,839 | 9/1990 | Rokutanzono et al. | 430/66 |
| 4,997,738 | 3/1991 | Kumakura et al. | 430/67 |
| 5,087,540 | 2/1992 | Murakami et al. | 430/58 |
| 5,104,929 | 4/1992 | Bilkadi | 524/847 |
| 5,124,220 | 6/1992 | Brown et al. | 430/67 |

OTHER PUBLICATIONS

Sato et al., JP 63–280260, English Translation Fuji Electric Co., Ltd.

Hirota, JP 1–134464, English Translation Fuji Electric, Co., Ltd.

Nakatani et al., JP 2–151870, English Translation Matsushita Electric, Industrial, Co., Ltd.

Matsuo, JP 4–37765, English Translation Matsushita Electric Industrial Co. Ltd.

*Primary Examiner*—Bernard Codd

[57] ABSTRACT

The present invention provides a photoconductor element for use in electrophotographic imaging, including a support, a photoconductive layer coated on the support, and a barrier layer coated on the photoconductive layer. The barrier layer includes an organic polymer and silica.

10 Claims, No Drawings

BARRIER LAYER FOR PHOTOCONDUCTOR ELEMENTS COMPRISING AN ORGANIC POLYMER AND SILICA

BACKGROUND OF THE INVENTION

The present invention relates to a photoconductor element for use in electrophotographic imaging and, in particular, to a barrier layer for a photoconductor element. The invention also relates to a method of producing a photoconductor element having a barrier layer.

The formation and development of images through electrophotographic imaging is well known. One electrophotographic imaging process involves the sequential steps of charging a photoconductor element, usually with a high voltage corona, forming an electrostatic latent image with laser exposure, developing the image by applying toner particles thereto to form a visible toner image corresponding to the electrostatic latent image, and transferring the toner image from the photoconductor element to a final substrate, such as paper, either by direct transfer or via an intermediate transfer material. The toner particles may be dispersed in either a dry or liquid medium, and may form black and white or full color images. Heat and pressure are often used to facilitate image transfer from the photoconductor element to the substrate.

The photoconductor element may take the form of a continuous belt which is supported and circulated by rollers, or may be adhered to the outer surface of a rotatable drum. Further, many different constructions exist for the photoconductor element. Common to all such constructions is a photoconductive layer which is formed from a material which acts as an insulator except when exposed to light. That is, the photoconductive layer does not conduct an electric current unless it is being exposed to light. Various organic and inorganic materials exist from which the photoconductive layer may be formed.

The photoconductive layer is generally affixed to and supported by an electroconductive support. The electroconductive support may be either negatively or positively charged such that when light strikes the photoconductive layer, electrons either flow from the electroconductive support and through the photoconductive layer (in the case of negatively charged electroconductive support), or through the photoconductive layer and into the electroconductive support (in the case of a positively charged electroconductive support).

In addition to the photoconductive layer and electroconductive support, other layers may be included in the photoconductor element. For example, a release layer topcoat may be included on the uppermost surface of the photoconductor element. This layer is constructed from a material having a low surface energy and serves to increase the efficiency with which toner particles are transferred from the surface of the photoconductor element. Silicone and fluorocarbon polymers have been previously described as effective for release layer applications.

Another type of layer which may be included in the photoconductor element is a barrier layer. A barrier layer may be positioned between the photoconductive layer and the release layer to protect the photoconductive layer. In this manner, the barrier layer enhances the durability and extends the service life of the photoconductive layer. To be effective in this capacity, the barrier layer should ideally meet many different performance criteria. First, the barrier layer should protect the photoconductive layer from damage due to corona-induced charge injection.

Such damage reduces the useful life of the photoconductive layer, and can be caused by the corona when placing a charge upon the surface of the photoconductor element. Damage occurs when the charge is permitted to directly contact the photoconductive layer. The corona also creates ozone and ionized particles which can further damage the photoconductive layer if permitted to directly contact that layer. Ozone, ionized particles, and charge from the corona are believed to damage the photoconductive layer by directly or indirectly causing unwanted reactions with the photoconductive layer, e.g., oxidation. An effective barrier layer is one which can prevent or substantially minimize direct contact of the photoconductive layer by the ozone, ionized particles, and charge which are produced by the corona.

A second requirement of the barrier layer is that it should be substantially inert with respect to the photoconductive layer. That is, the barrier layer should not chemically react with the photoconductive layer to the extent that the performance of the photoconductive layer is detrimentally affected and "trap sites" form between the barrier layer and the photoconductive layer. Trap sites are localized electrical voids which can retain electrons as the electrons attempt to flow through the photoconductor element in the areas which have been light struck, e.g., from a negatively charged electroconductive support to neutralize a positively charged surface of a photoconductor element, the positive charge being placed there by a corona (the inverse case is also possible where the electroconductive support is positively charged and a negative charge is placed upon the surface of the photoconductor element by the corona). Current cannot flow between the support and the surface until a sufficient number of electrons are retained in the trap sites to provide a conductive path therethrough. Until the trap sites are adequately filled with electrons in this manner, the surface of the photoconductor element cannot be adequately discharged when exposed by a light source because a sufficient number of electrons will not be able to flow between the electroconductive support and the surface to neutralize all of the charge in the light struck areas.

Trap sites thus result in long warm-up (or burn-in) periods before the photoconductor element is ready to produce high quality toner images. During such warm-up periods, the photoconductor element is repeatedly charged by the corona and discharged by a light source in order to allow the trap sites to fill with electrons. Any images produced before adequate warm-up will be of poor quality due to insufficient toner particle attraction in the image-wise exposed areas. Moreover, when the imaging device housing the photoconductor element is turned off, the trap sites may become emptied once again. Thus, the next time the imaging device is turned on, another warm-up period is required. This problem is known as "reset."

A third requirement of the barrier layer is that it should adhere well to the photoconductive layer and the release layer without the need for adhesives. Fourth, when the photoconductor element is used in belt form, the barrier layer should exhibit sufficient resiliency to withstand the compressional and tensional forces exerted on the photoconductor element as it travels around the aforementioned system of rollers.

A fifth requirement exists when liquid toner systems are used. Liquid toner systems generally include toner particles dispersed in a carrier liquid, and may include other constituents such as charge control agents. The barrier layer should be capable of substantially limiting or preventing the liquid toner system from coming into contact with the photoconductive layer. The toner particles, carrier liquid, and other constituents can damage and/or shorten the service life of the photoconductive layer.

Although many barrier layer formulations have been proposed, none have been found which are capable of satisfactorily meeting all of the above-stated performance criteria. For example, U.S. Pat. Nos. 4,439,509, 4,606,934, 4,595,602, and 4,923,775 disclose a protective overcoating utilizing a cross-linkable siloxanol-colloidal silica hybrid material. The siloxanol-colloidal silica hybrid material is generally formed by combining a trialkoxysilane, a colloidal silica hydrosol, and an organic acid. U.S. Pat. No. 4,439,509 discloses that the siloxanol-colloidal silica hybrid material is cross-linked with ammonia gas to form the protective overcoating. U.S. Pat. No. 4,606,934 discloses that when no organic acid is used to form the siloxanol-colloidal silica hybrid material, an acid number of less than 0.5 can be achieved. U.S. Pat. No. 4,595,602 discloses that the siloxanol-colloidal silica hybrid material is combined with a hydrolyzed ammonium salt of an alkoxy silane to produce the protective overcoating. U.S. Pat. No. 4,923,775 provides that the siloxanol-colloidal silica hybrid material is combined with a silane having an electron accepting moiety.

Each of above-described protective overcoatings as recited in U.S. Pat. Nos. 4,439,509, 4,606,934, 4,595,602, and 4,923,775 result in photoconductor elements which require relatively long warm-up periods, and which often "reset" such that long warm-up periods are required each time the respective photoconductive imaging device is turned on. These problems are believed to result from the formation of trap sites between the overcoating and the photoconductive layer due to chemical reaction between the overcoating and the photoconductive layer.

Moreover, the above overcoatings do not provide the photoconductive layer with adequate protection from liquid contact when a toner dispersed in a carrier liquid is utilized. In addition, such overcoatings provide insufficient resiliency to be used in belt form. When tested as such, the overcoatings developed stress fractures.

U.S. Pat. No. 4,565,760 discloses a protective overcoating formed from a dispersion of hydroxylated silsesquioxane and colloidal silica in an alcoholic medium. Such an overcoating, however, suffers from the same deficiencies as those described immediately above (i.e. long warm-up periods, reset problems, poor liquid toner carrier protection, and insufficient resiliency).

U.S. Pat. No. 5,124,220 discloses a photoconductor element having a barrier layer and a release layer. The barrier layer is formed from an organic polymer such as one resulting from a mixture of polyvinyl alcohol with methylvinylether/maleic anhydride copolymer. This barrier layer provides good carrier liquid protection but does not protect the photoconductive layer from corona-induced charge injection and ozone/ionized particle creation.

Accordingly, a need exists in the art for a barrier layer which meets all of the above-listed performance criteria, i.e., one which provides charge injection protection, is substantially inert with respect to the photoconductive layer, adheres well to the photoconductive layer and to the release layer, exhibits sufficient resilience to be used in belt form, and protects the photoconductive layer from contact with toner carrier liquid.

SUMMARY OF THE INVENTION

The present invention provides a photoconductor element for use in electrophotographic imaging, comprising a support, a photoconductive layer coated on the support, and a barrier layer coated on the photoconductive layer. The barrier layer comprises a composite structure which includes an organic polymer and silica. The organic polymer is preferably selected from the group consisting of polyacrylates, polyurethanes, polyvinyl acetals, sulfonated polyesters, and mixtures of polyvinyl alcohol with methylvinylether/maleic anhydride copolymer. The organic polymer and silica are preferably present in the barrier layer at a silica to polymer weight ratio ranging from about 9:1 to about 1:1.

The present invention also provides a method for producing a photoconductor element having a barrier layer. The method generally comprises the steps of:

a) providing a support;

b) applying a photoconductive layer to the support;

c) coating a barrier layer composition on the photoconductive layer; and d) curing the barrier layer composition to form a barrier layer. The barrier layer composition preferably comprises an organic polymer and colloidal silica.

The unique combination of an organic polymer with silica enables the barrier layer of the present invention to reasonably meet all of the above-listed performance criteria, i.e., it provides significant charge injection protection, is substantially chemically inert with respect to the photoconductive layer, adheres well to the photoconductive layer and to the release layer, exhibits sufficient resilience to be used in belt form, and minimizes contact of the photoconductive layer by liquid toner systems.

DETAILED DESCRIPTION OF THE INVENTION

In a preferred embodiment, the photoconductor element of the present invention includes, in order, an electroconductive support, a photoconductive layer coated on a major surface of the support, a barrier layer coated on the photoconductive layer, and a release layer topcoat coated on the barrier layer.

Thus, the release layer forms the uppermost layer of the photoconductor element with the barrier layer sandwiched between the release layer and the photoconductive layer. The photoconductor element may take the form of a continuous belt which is supported and circulated by rollers, or a rotatable drum with the photoconductive, barrier, and release layers being located on the outer surface of the drum. Further, the photoconductor element may be used equally well in systems which employ dry or liquid-dispersed toner, and the toner may produce either black and white or full color images. As will be appreciated, however, use of the photoconductor element of the present invention with liquid-dispersed toner systems is particularly advantageous.

Electroconductive supports for photoconductive systems are well known in the art and can be of two general classes: (a) self-supporting layers or blocks of conducting metals, or other highly conductive materials; (b) insulating materials, such as polymer sheets, glass, or paper, to which a thin conductive coating, e.g., vapor coated aluminum, has been applied. The support may take any form such as a belt, drum, sheet or the like.

The photoconductive layer can be of any type known in the art, including an organic photoconductor or a dispersion of an inorganic photoconductor material in particulate form dispersed in a suitable binder. The thickness of the photoconductive layer is dependent upon the material used, but is typically in the range of 5 to 150 micrometers. In the case of an organic photoconductor, the photoconductive layer can be a bilayer construction consisting of a charge generating layer and a charge transport layer. The charge generating layer includes a material which is capable of absorbing light to generate charge carriers, such as a dyestuff or pigment, while the charge transport layer includes a material capable of transferring the generated charge carriers, such as poly-N-vinylcarbazoles or derivatives of bis-(benzocarbazole)-phenylmethane in a suitable binder.

Alternatively, an organic photoconductive layer can comprise a single-layer construction having both charge generating and charge transport capabilities. Examples of single-layer organic photoconductive layers are described in U.S. Pat. Nos. 5,087,540 and 3,816,118. U.S. Pat. No. 5,087,540 describes a photoconductive layer constructed from a metal-free phthalocyanine compound dispersed in a binder resin. To make the dispersion, the phthalocyanine compound is milled in a solvent along with the binder resin until charge transportability and charge generating ability are developed in the resultant photoconductive layer. Suitable binder resins include polyesters, polyvinyl acetate, polyvinyl chloride, polyvinylidene chloride, polycarbonates, polyninyl butyral, polyvinyl acetoacetal, polyvinyl formal, polyacrylonitrile, polymethyl methacrylate, polyacrylates, polyvinyl carbazoles, copolymers of monomers used in the above-mentioned polymers, vinyl chloride/vinyl acetate/vinyl alcohol terpolymers, vinyl chloride/vinyl acetate/maleic acid terpolymers, ethylene/vinyl acetate copolymers, vinyl chloride/vinylidene chloride copolymers, cellulose polymers and mixtures thereof. Suitable solvents include nitrobenzene, chlorobenzene, dichlorobenzene, trichloroethylene, tetrahydrofuran, and the like. Such single-layer organic photoconductive layers are preferred.

Inorganic photoconductors such as, for example, zinc oxide, titanium dioxide, cadmium sulfide, and antimony sulfide, dispersed in an insulating binder are well known in the art and may be used in any of their conventional versions with the addition of sensitizing dyes where required.

The release layer topcoat may comprise any release layer composition known in the art. A preferred release layer is one containing a silicone polymer, such as those described in U.S. Pat. No. 4,600,673. Fluorosilicone polymers may also be used.

The barrier layer comprises a composite material containing an organic polymer and silica. The organic polymer and silica are preferably present in the barrier layer at a silica to polymer weight ratio ranging from 9:1 to 1:1. More preferably, the ratio ranges from about 3:1 to 1.2:1, and even more preferably from about 2.5:1 to 1.5:1. The most preferred ratio is 2:1. If the silica content of the barrier layer is too high, the barrier layer becomes too brittle and does not adhere well to the release and photoconductive layers. On the other hand, if the silica content is too low, the barrier layer provides insufficient charge injection and ozone/ionized particle protection to the photoconductive layer.

The barrier layer is formed by applying a barrier layer composition, containing an organic polymer and a source of silica (e.g. colloidal silica), to a photoconductive layer. The barrier layer composition can be applied to the photoconductive layer, in web form, drum form or the like, by any known coating method, including slide coating, bar coating, roll coating, knife coating, curtain coating, rotogravure coating, spraying, dipping, etc. The barrier layer composition is then cured, e.g. by thermal curing (120–150° C. for 5–10 minutes), to cause the organic polymer and colloidal silica to cross-link, thereby forming an organic polymer/silica composite structure. The final, cured barrier layer preferably has a thickness ranging from about 0.1 to about 5 microns. More preferably, the thickness ranges from about 0.3 to about 2 microns, and most preferably from about 0.4 to about 0.8 microns.

The term "organic polymer" is intended to define a polymeric material which is formed from a carbon chain or ring, and which also contains hydrogen. The polymeric material may also contain other elements such as, e.g., sulfer, oxygen or nitrogen. As herein defined, the term "organic polymer" thus describes a polymeric material in which the backbone thereof is constructed of carbon. Specifically excluded from the backbone are other elements such as silicon. As will be discussed below, ambifunctional silanes may be used as coupling agents to aid the cross-linking of the organic polymer with the colloidal silica to form the organic polymer/silica composite structure. In this instance, pendent silane or siloxane units may be attached to the carbon backbone of the organic polymer (with the opposite end of the ambifunctional silane being attached to silica). However, the silane or siloxane units will not become part of the carbon backbone of the organic polymer, but will merely be attached thereto.

In applications where liquid toner systems are to be used, the organic polymer must provide the silica/organic polymer composite with sufficient resistance to the liquid toner system that the photoconductive layer will not be deleteriously affected by the components of such a system. At the very least, the organic polymer must not be dissolvable by the toner carrier liquid and, more preferably, should minimize or eliminate penetration of the carrier liquid into the photoconductive layer. A commonly used toner carrier liquid is Norpar®12, a paraffinic hydrocarbon commercially available from the Exxon Chemical Company. Another commercially available toner carrier liquid is Isopar®G.

Toner particles, charge control agents and other constituents of the liquid toner system accompany the carrier liquid when it penetrates into the photoconductive layer. Each of these components has a negative impact on the performance and longevity of the photoconductive layer. Thus, it is important to minimize contact of the liquid toner system with the photoconductive layer by limiting or preventing penetration of the carrier liquid into the photoconductive layer.

Further desired physical properties which the organic polymer should ideally possess include optical clearness (i.e. no light scatter), a glass transition temperature above 50° C., the ability to form a film, and sufficient resiliency to allow the photoconductor element to be used in belt form.

Organic polymers which have been found to possess all of the above-recited properties include polyacrylates, polyurethanes, polyvinyl acetals, sulfonated polyesters, and mixtures of polyvinyl alcohol with methylvinylether/maleic anhydride copolymer. Preferred polyacrylates include polyacrylic acids and acrylate/acrylic acid copolymers. Preferred polyvinyl acetals include polyvinyl butyrals.

Of the above-listed organic polymers, mixtures of polyvinyl alcohol with methylvinylether/maleic anhydride copolymer are most preferred. The weight ratio of polyvinyl alcohol to methylvinylether/maleic anhydride copolymer in such mixture preferably ranges from about 5:1 to about 15:1, with a ratio of 12:1 being preferred.

The silica component of the barrier layer provides charge injection and ozone/ionized particle protection to the photoconductive layer; i.e. it prevents corona-induced charge, ozone, and ionized particles from directly contacting and thereby damaging the photoconductive layer. In this manner, the silica component helps to extend the service life of the photoconductive layer.

As is conventionally understood, silica is a three dimensional network of silica and oxygen having an average of two oxygen atoms for every silica atom. Such a network has been found to provide an effective barrier against corona-induced charge, ozone, and ionized particles so that, when layered between the corona and photoconductive layer, the silica network protects the photoconductive layer from the otherwise damaging effects of direct contact with corona-induced charge, ozone, and ionized particles.

While the silica component of the barrier layer provides charge injection and ozone/ionized particle protection to the photoconductive layer, it alone does not provide sufficient protection from liquid contact when a toner dispersed in a carrier liquid is utilized. Hence, an organic polymer which is capable of providing such protection is incorporated into the barrier layer along with silica. In this manner, a multi-functional composite structure is provided.

The barrier layer composition from which the barrier layer composite structure is formed includes an organic polymer and a substance which will yield a three dimensional silica network. The preferred starting material from which the silica can be obtained is colloidal silica. As is known, the term "colloidal silica" refers to a colloidal dispersion of silicon dioxide ($SiO_2$) particles. The colloidal silica may be dispersed in any liquid medium provided that the organic polymer is selected to be dispersible or soluble therein. In this manner, the colloidal silica and organic polymer can be intimately mixed so that the barrier layer composition is substantially homogenous.

The colloidal silica particles may range in size from 5 to 30 nanometers, with 5 nanometers being preferred. Suitable colloidal silica is commercially available from Nalco Chemical Company. Examples include, but are not limited to, Nalco®2326 (water dispersed, base stabilized), Nalco®1042 (water dispersed, acid stabilized), and Nalco®1057 (alcohol dispersed).

The barrier layer composition is coated on the photoconductive layer and cured to form the silica/organic polymer composite structure. During the curing process, the liquid medium in which the organic polymer and colloidal silica are contained is driven off. As this occurs, an intricate cross-linking process begins. Formerly separated colloidal silica particles cluster and react with one another to form the 3-dimensional silica network. At the same time, the organic polymer and newly formed silica network cross-link together. The end result is an intermixed composite structure having segments of organic polymer bonded to segments of silica.

To aid the cross-linking of the organic polymer with the silica network, it is preferred that a coupling agent be included in the barrier layer composition. Effective coupling agents include ambifunctional silanes such as 3-glycidoxypropyltrimethoxysilane, vinyltrimethoxysilane, chloromethyltrimethoxysilane, methyltrimethoxysilane, and 3-aminopropyltriethoxysilane. As discussed hereinabove, the silane or siloxane units contributed by such ambifunctional silanes may be attached to the carbon backbone of the organic polymer, but will not become part of the backbone itself.

Other materials which may be included in the barrier layer, or in the photoconductive, release, or other intermediate or auxiliary layers, include dyes and pigments for coloration, image enhancement, spectral sensitization, brightening, or the like; surfactants, coating aids, and slip agents; conductive polymers or particles; etc.

Advantageously, the organic polymer/silica composite of the present invention provides a barrier layer having a unique combination of features which heretofore has not been possible. First, due to the presence of silica, the present barrier layer prevents the photoconductive layer from being directly contacted by corona-produced charge, ozone, and ionized particles, thereby extending the useful life of the photoconductive layer. Second, the organic polymer/silica composite is substantially inert with respect to the photoconductive layer. As a result, the barrier layer does not degrade the performance of the photoconductive layer. Further, no "trap sites" form between the barrier layer and the photoconductive layer. Consequently, only a short or no warm-up period is required before the photoconductor element is ready to produce high quality toner images, and the problem of "reset" is not encountered.

A third feature of the present barrier layer is that it adheres well to the release layer and to most photoconductive layers, particularly to organic photoconductive layers, without the need for adhesives. The organic polymer component of the barrier layer provides adhesion to the photoconductive layer while the silica component provides adhesion to the release layer. A fourth feature is that the organic polymer contributes enough resilience to the barrier layer that it can be used in belt form.

A fifth feature of the present barrier layer is substantial resistance to known liquid carriers in liquid toner systems. The organic polymer component limits or prevents the carrier liquid, toner particles, and other components of the liquid toner system from coming into contact with the photoconductive layer, thereby preventing damage to and increasing the useful service life of the photoconductive layer.

Although barrier layers possessing one or some of the above-listed features of the present barrier layer are known, no currently existing barrier layer is known to possess all of the instant features. And yet, although a wide variety of features are provided, the barrier layer of the present invention does so without interfering with the optical or electrical performance of the photoconductive layer so that the photoconductor element is capable of producing high quality toner images. The present barrier layer, however, allows the photoconductor element to do so more reliably and for a longer period of time than would otherwise be possible.

In order that the invention may be more readily understood, reference is made to the following examples, which are intended to be illustrative of the invention, but are not intended to be limiting in scope.

EXAMPLES 1–18

A. BARRIER LAYER PREPARATION

Various barrier layer compositions were prepared, coated onto an organic photoconductive layer, and cured so that the resultant barrier layers could be evaluated. The barrier layer compositions are set forth in Table 1 while the evaluation results of barrier layers produced from such compositions are set forth in Table 2.

The organic photoconductive layer (hereinafter referred to as the "OPC" layer) used in each of the examples was constructed in accordance with U.S. Pat. Nos. 3,816,118 and 5,087,540. The OPC was of a single-layer construction and contained 16% by weight x-form metal free phthalocyanine as charge generator and charge carrier (commercially available from ICI, Ltd.), and 84% by weight polyvinyl butyral as binder (commercially available as Butvar™ B-76 from Monsanto). The OPC layer was between 8–10 microns in thickness for each example.

Set forth immediately below are sample preparation procedures used to produce several of the barrier layer examples shown in Tables 1 and 2.

1. Example 5—Comparative Example

This sample preparation procedure is illustrative of Examples 1–5 (all comparative examples), in which barrier layers consisting of silanes only were prepared (Example 1 further included a small amount of silicone).

1.24 grams of 3-aminopropyltrimethoxysilane (commercially available from Hul America) was dissolved into 48.4 grams of absolute ethanol. To this solution 0.4 gram of deionized (DI) water was also added. The solution was stirred and allowed to age for 24 hours. The total solids content of this solution was 1.75%. After aging, the final barrier layer solution was coated onto the above-described OPC layer with a 19 Meyer bar, and the coated film was cured at 125° C. for 30 minutes, thereby forming the barrier layer. The calculated thickness of the barrier layer was 0.3 micron. The barrier coated OPC layer was allowed to cool for 30 minutes prior to any evaluation thereof.

2. Example 9—Comparative Example

This sample preparation procedure is illustrative of Examples 6–9 (all comparative examples), in which barrier layers similar to those described in U.S. Pat. Nos. 4,439,509, 4,606,934, 4,595,602, and 4,923,775 were prepared. As disclosed in those references, the barrier layers of Examples 6–9 comprise a trialkoxysilane (methyltrimethoxysilane and 3-glycidoxypropyltrimethoxysilane or vinyltrimethoxysilane) and colloidal silica.

0.08 gram of methyltrimethoxysilane (commercially available from Hul America) and 0.08 grams of vinyltrimethoxysilane (Hul America) were dissolved in a mixture of 9.2 grams of deionized water and 5.0 grams of ethanol. To this solution, 10 grams of a 14.5% colloidal silica solution (commercially available Nalco® 2326) and 0.02 gram of a surfactant (Triton™ X-100, commercially available from Union Carbide) were added. The solution was stirred and aged for 24 hours. The total solids content of this solution was 3.5%. After aging, the solution was coated onto the above-described OPC layer with a #6 Meyer bar, and the coated film was cured at 125° C. for 30 minutes, thereby forming the barrier layer. The calculated thickness of the barrier layer was 0.4 micron. The barrier coated OPC layer was allowed to cool for 30 minutes prior to any evaluation thereof.

3. Example 15—Comparative Example

This sample preparation procedure is illustrative of Example 15 (a comparative example), in which a barrier layer similar to that described in U.S. Pat. No. 5,124,220 was prepared. As taught by that reference, the barrier layer is formed from an organic polymer alone, such as the polymer which results from a mixture of polyvinyl alcohol with methylvinylether/maleic anhydride copolymer.

Initially, two different stock solutions, A and B, were prepared. Solution A was a 2% polyvinyl alcohol (PVA) aqueous solution consisting of 98 grams of deionized water and 2.0 grams of PVA (Elvanol™ 50-42, commercially available from Du Pont). Solution B was a 0.6% Gantrez™ solution in methanol/water, consisting of 99.4 grams of methanol/water (75/25) and 0.6 grams of Gantrez™ AN-169 (a methylvinylether/maleic anhydride copolymer commercially available from GAF Corp.). To 20 grams of solution A, 8 grams of solution B and 0.02 gram of Triton™ X-100 (a commercially available surfactant from Union Carbide) were added. The total solids content of the resultant barrier layer solution was 1.6%.

The barrier layer solution was coated onto the above-described OPC layer with a #9 Meyer bar, and the coated film was cured at 125° C. for 30 minutes to form the barrier layer. The calculated thickness of the barrier layer was 0.3 micron. The barrier coated OPC layer was allowed to cool for 30 minutes prior to any evaluation thereof.

4. Example 13

This sample preparation procedure is in accordance with the practice of the present invention. The barrier layer contains colloidal silica, an organic polymer (a mixture of PVA and Gantrez™ AN-169), and a coupling agent (methyltrimethoxysilane).

0.08 gram of methyltrimethoxysilane coupling agent (commercially available from Hul America) was dissolved in a mixture of 7 grams of deionized water and 5.0 grams of ethanol. To this solution 4.8 grams of a 14.5% colloidal silica solution (commercially available Nalco® 2326) and 0.02 gram of a surfactant (Triton™ X-100, commercially available from Union Carbide) were added. Next, 12.1 grams of an organic polymer solution (1.6% by weight), consisting of 1.4 part PVA (Elvanol™ 50-42 from Du Pont), 0.2 part Gantrez™ AN-169 (methylvinylether/maleic anhydride copolymer from GAF Corp.) and 98.4 parts water, was added into the diluted colloidal silica solution and agitated by a shaker table for 0.5 hour. The solution was then stirred and aged for 24 hours. Total solid content for this solution was 3.5%. Finally, the coating solution was coated onto the above-described OPC layer with a #6 Meyer bar, and the coated film was cured at 125° C. for 30 minutes. The sample was allowed to cool for 30 minutes prior to evaluation thereof. The calculated coating thickness was 0.4 micron.

5. Example 16

This sample preparation procedure is in accordance with the practice of the present invention. The barrier layer contains colloidal silica, an organic polymer (a mixture of PVA and Gantrez™ AN-169), and a coupling agent (3-glycidoxypropyltrimethoxysilane).

0.15 gram of 3-glycidoxypropyltrimethoxysilane coupling agent (from Hul America) was dissolved into 6.5 grams of deionized water. To this solution, 3.1 grams of a 14.5% colloidal silica solution (commercially available Nalco® 2326) and 0.02 gram of a surfactant (Triton™ X-100, commercially available from Union Carbide) were added. Next, 22.3 grams of an organic polymer solution (1.6% by weight), consisting of 2.4 part PVA (Elvanol™ 7 50-42 from Du Pont), 0.2 part Gantrez™ AN-169 (methylvinylether/maleic anhydride copolymer from GAF Corp.) and 98.4 parts water, was added into the diluted colloidal silica solution and agitated by a shaker table for 0.5 hour. The solution was then stirred and aged for 24 hours. Total solid content for this solution was 2.8%. Finally, the coating solution was coated onto the above-described OPC layer with a #16 Meyer bar, and the coated film was cured at 125° C. for 30 minutes. The sample was allowed to cool for 30 minutes prior to evaluation thereof. The calculated coating thickness was 0.4 micron.

6. Example 18

This sample preparation procedure is in accordance with the practice of the present invention. The barrier layer contains colloidal silica, an organic polymer (polyvinylbutyral), and a coupling agent (3-glycidoxypropyltrimethoxysilane).

0.24 gram of polyvinylbutyral (B-98, commercially available from Monsanto) was dissolved into 5.76 grams of isopropanol. Added to this solution were 1.6 grams of a 14.5% alcohol-based colloidal silica solution (commercially available as Nalco® 1057) and 0.2 gram of a 10% aqueous Triton™ X-100 solution (commercially available from Union Carbide). Next, 6.4 grams of deionized water, 8 grams of isopropanol, and 1.0 gram of 5% prehydrolyzed 3-glycidoxypropyltrimethoxysilane (from Hul America) were added into the diluted colloidal silica solution and agitated by a shaker table for 0.5 hour. The solution was stirred and aged for 24 hours. The total solids content of this solution was approximately 3%. Finally, the solution was coated onto the OPC layer, and the coated film was cured at 125° C. for 30 minutes. The resultant barrier layer was allowed to cool for 30 minutes prior to any evaluation thereof. The coating thickness of the barrier layer was estimated to be between 0.4 and 0.8 micron.

The compositions of these and the other barrier layer solutions which were prepared are summarized in Table 1.

barrier layer, corresponding to one of the barrier layer compositions in Table 1, was coated onto the outer surface of the OPC layer such that the barrier layer formed the outer surface of the resultant photoconductor element. The photoconductor element was continuously charged up to 650 volts by a DC corona and immediately discharged by rastering the surface of the photoconductor element with a 780 nm diode laser. A 715 nm wavelength erase lamp with 2 microwatts/cm$^2$ intensity was used to remove any residual voltage from the photoconductor element during each charging/discharging cycle. The drum speed during testing was approximately 3"/sec. This procedure was repeated for each of the barrier layer compositions shown in Table 1. The results of the evaluation are summarized in Table 2.

The extent of warm-up required by each photoconductor element was determined by measuring the number of charging/discharging cycles necessary before the initial charge of approximately 650 volts could be adequately discharged by the laser. The relative warm-up periods associated with each barrier layer composition is noted in Table 2 under the "Comment" column as being either "short," "moderate," or "long," with "short" being preferred. A short warm-up period is 1–2 cycles, a moderate warm-up period is 10–20 cycles, and a long warm-up is more than 20 cycles.

TABLE 1

| Ex. | water | alcohol | silane 1[1] | silane 2[2] | silane 3[3] | Other | organic polymer | colloidal 1 silica[4] | % solid |
|---|---|---|---|---|---|---|---|---|---|
| 1 | 0.4 | 96.9 | 0.85 | 0.85 | — | 0.4, silicone[5] | — | — | 1.75 |
| 2 | 0.4 | 96.9 | 0.85 | 0.85 | — | — | — | — | 1.75 |
| 3 | 0.14 | 49.13 | — | 0.89 | 0.14 | — | — | — | 1.75 |
| 4 | 0.4 | 48.2 | — | 0.85 | 0.34 | — | — | — | 1.75 |
| 5 | 0.4 | 48.4 | — | — | 1.24 | — | — | — | 1.75 |
| 6 | 15.0 | 5.0 | — | 0.04 | — | 0.04, GPS[6] | — | 5.0 | 3.5 |
| 7 | 15.0 | 5.0 | — | 0.04 | — | 0.04, VPS[7] | — | 5.0 | 3.5 |
| 8 | — | 20.0 | — | 0.04 | — | 0.04, VPS | — | 5.0 | 3.5 |
| 9 | 9.2 | 5.0 | — | 0.08 | — | 0.08, VPS | — | 10.0 | 8.0 |
| 10 | 17.5 | — | — | 0.04 | — | 0.04, VPS | 7.5, PAA/SI[8] | | 3.5 |
| 11 | 13.6 | 5.0 | — | 0.04 | — | 0.04, VPS | 7.5, PAA/SI | | 3.5 |
| 12 | 10.3 | 5.0 | — | 0.08 | — | — | 4.88, PVA/GAN[9] | 4.8 | 3.5 |
| 13 | 7.0 | 5.0 | — | 0.08 | — | — | 12.1, PVA/GAN | 4.0 | 3.5 |
| 14 | 10.0 | — | — | 0.08 | — | — | 22.0, PVA/GAN | 2.5 | 2.4 |
| 15 | — | — | — | — | — | — | 20.0, PVA/GAN | — | 1.6 |
| 16 | 6.5 | — | — | — | — | 0.15, GPS | 22.3, PVA/GAN | 3.1 | 2.8 |
| 17 | — | — | — | — | — | 0.15, GPS | 30.0, PVA/GAN | 2.5 | 2.8 |
| 18 | 6.4 | 13.76 | — | — | — | 1.0, GPS | 0.24, PVB[10] | 1.6 | 3.0 |

[1]"silane 1" is chloromethyltrimethoxysilane.
[2]"silane 2" is methyltrimethoxysilane.
[3]"silane 3" is 3-aminopropyltrimethoxysilane.
[4]NALCO ® 2326 colloidal silica was used for Examples 1–18; NALCO ® 1057 was used for Example 18.
[5]The silicone used in Example 1 (a comparative example) was moisture curable and had a molecular weight of approximately 5000.
[6]"GPS" is 3-glycidoxypropyltrimethoxysilane.
[7]"VPS" is vinyltrimethoxysilane.
[8]PAA/SI is a solution of polyacrylic acid and colloidal silica (Nalco ® 1040). The ratio of colloidal silica to polyacrylic acid was 9:1. The solution had a solids content of 10%.
[9]PVA/GAN is a mixture of polyvinyl alcohol polymer (2.0% in water) and methylvinylethermaleic anhydride copolymer solution (0.6% in methanol/water 75/25). Total percent solid is 1.6%. The ratio between these two polymers is 7:1 (Examples 12–15). In Example 16, the ratio between the two polymers is 12:1 and the total solid % was 1.33.
[10]"PVB" is polyvinylbutyral.

B. BARRIER LAYER EVALUATION

Each of the barrier layer compositions set forth in Table 1 were coated onto an OPC layer (as described above) and cured so that the resultant barrier layers could be evaluated. The properties for which the barrier layers were evaluated included warm-up times, "reset," and charge injection protection.

To study these properties, various photoconductor elements were prepared by applying and grounding an OPC layer to an aluminum drum with copper conductive tape. A The propensity of each photoconductor element to "reset" was measured by shutting down the testing apparatus and then restarting it to determine whether a warm-up period was again necessary before the initial charge of approximately 650 volts could be discharged by the laser. If such a warm-up period was again necessary, the photoconductive layer was said to have "reset." Reset propensities are noted in Table 2 under the "Comment" column.

The charge injection protection offered by each barrier layer was approximated by gauging the ability of the photoconductor element to adequately charge up and discharge over several thousand charge/discharge cycles. In this manner, the likely service life of each photoconductor element could be determined. As mentioned, the initial charge voltage placed on the surface of each photoconductor element by the corona was approximately 650 volts. This voltage is designated as "$V_o$" in Table 2. Although the same voltage was supplied to the corona for all tests, $V_o$. varied slightly from 650 volts in some instances due to variations in the composition of the barrier layer and in the thickness of the OPC layer.

When the OPC begins to deteriorate due to charge injection (i.e. corona-induced deterioration from direct charge, ozone, and ion contact), the amount of charge which can be maintained on the surface of the photoconductor element decreases. Eventually, the charge-up capacity of the photoconductor element is educed to the point where the toner images are no longer acceptable (e.g. toner particles begin to adhere to areas on the surface of the photoconductor element other than those areas which have been struck by the laser, thereby causing a darkened background image). It is at this point that the useful service life of the photoconductor element is at an end the photoconductor element must be replaced. During the evaluation of the photoconductor elements, this point of failure was deemed to be reached when the photoconductor element could no longer hold a charge of 400 volts. When this occurs, the image background is unacceptably dark.

During the evaluation, each photoconductor element was charged and discharged through at least 8000 cycles. At the end of that period, the amount of charge which could be maintained on the photoconductor element was measured. If this value (designated "$V_f$" in Table 2) was below 400 volts after only 8000 cycles, the photoconductor element was deemed to have failed prematurely, i.e., the barrier layer did not provide sufficient protection from charge injection or ozone/ionized particle contact.

In Examples 1–12, the evaluation was terminated after 8000 cycles. However, those photoconductor elements having barrier layers which looked particularly promising, namely Examples 13, 16, 17, and 18, were tested through additional cycles. At the end of the testing period, the final charge-up value, "$V_f$," was noted and recorded.

During the testing period, the amount of charge which could be maintained on the photoconductor element was measured and recorded at ten equally spaced intervals. Thus, for an 8000 cycle evaluation, the charge up value was measured every 800 cycles. In this manner, the number of cycles at which the photoconductor element failed could be estimated (if failure occurred prior to the end of the testing period).

TABLE 2

| Ex. | Number of tested cycles before failure ($V_f$ < 400 volts) | $V_o$ | $V_v$ | Comment |
|---|---|---|---|---|
| 1 | <1000 | 650 | 250 | poor, short warm-up |
| 2 | <1000 | 650 | 250 | poor, short warm-up |
| 3 | <5000 | 650 | 350 | moderate warm-up, reset |
| 4 | <8000 | 650 | 350 | long warm-up, reset |
| 5 | <3000 | 650 | 250 | short warm-up |
| 6 | >8000 | 620 | 550 | good, moderate warm-up |
| 7 | >8000 | 620 | 550 | good, moderate warm-up |
| 8 | — | 700 | 580 | long warm-up, fast reset |
| 9 | >8000 | 620 | 550 | good, moderate warm-up, no reset |

TABLE 2-continued

| Ex. | Number of tested cycles before failure ($V_f$ < 400 volts) | $V_o$ | $V_v$ | Comment |
|---|---|---|---|---|
| 10 | >8000 | 600 | 550 | good, short warm-up, no reset |
| 11 | >8000 | 600 | 550 | good, short warm-up, no reset |
| 12 | >8000 | 600 | 550 | good, short warm-up, no reset |
| 13 | >24000 | 650 | 520 | good, short warm-up, no reset |
| 14 | <2000 | 650 | 350 | short warm-up |
| 15 | <1000 | 600 | 250 | short warm-up |
| 16 | >24000 | 650 | 600 | good, short warm-up, no reset |
| 17 | <24000 | 650 | 300 | good, some charge fatigue after 20,000 cycles |
| 18 | >12000 | 600 | 550 | good, short warm-up, no reset |
| OPC control | <1000 | 600 | 150 | short warm-up |

As the results in Table 2 indicate, the barrier layers of Examples 1–5 (comparative examples) provided very little protection from corona-induced charge, oxygen, and ionized particle damage, thus resulting in premature OPC failure. In addition, Examples 3 and 4 resulted in moderate to long warm-up periods as well as reset problems (indicating the formation of trap sites).

The barrier layers of Examples 6–9 provided adequate charge injection and ozone/ionized particle protection. However, all of those barrier layers resulted in unacceptable (moderate to long) warm-up periods, strongly indicative of the formation of trap sites. The warm-up period in Example 8 was so long, and the reset so fast, that the test was terminated after 150 cycles. As will be discussed below, the barrier layers of Examples 6–9 also failed to adequately protect the photoconductive layer from damaging contact with toner carrier liquid.

The barrier layers of Examples 10–13, 16, and 18 were prepared in accordance with the practice of the present invention. Each of these barrier layers provided good protection from corona-produced charge, ozone, and ionized particle contact, and resulted in only a short warm-up with no reset. This is particularly well illustrated in Examples 13, 16, and 18, where the OPC was still in excellent condition after 24,000 cycles, 24,000 cycles, and 12,000 cycles, respectively.

While the barrier layer of Example 14 resulted in a short warm-up period, this barrier layer did not contain enough silica to provide adequate charge injection and ozone/ionized particle protection. The barrier layer had a silica to organic polymer weight ratio of about 1:1. Similarly, the barrier layer of Example 17 did not contain enough silica. The barrier layer of Example 15 further illustrates this point. That barrier layer contained no silica and the OPC failed before 1000 cycles.

The "OPC control" sample was subjected to the same testing as Examples 1–18 but contained no barrier layer. This OPC failed before 1000 cycles.

Examples 19–23

Certain representative barrier layer compositions from Table 1 were coated onto an OPC layer and cured so that the ability of the resultant barrier layers could be evaluated for their ability to provide a barrier to infiltration by toner carrier liquid.

The OPC layer was prepared by adding a UV dye (1,2-bisstilbene) to an 8–10% solids "OPC solution" of x-form metal free phthalocyanine (commercially available from ICI, Ltd.) and polyvinyl butyral (commercially available as Butvar™ B-76 from Monsanto) in tetrahydrofuran. The solids portion of the solution contained 16% by weight x-form metal free phthalocyanine and 84% by weight polyvinyl butyral. With a #12 Meyer bar, this UV dye/OPC solution was coated onto the upper surface of a polyester sheet having a vapor-coated aluminum layer interposed between the polyester sheet and the OPC layer. The OPC coated sheet was air dried overnight. The final concentration of the UV-dye in the OPC layer was 2% by weight.

After air drying, the OPC coated sheet was cut into 3"×4" portions. Several different barrier layer compositions from Table 1 were coated onto the upper surface and sides of the 3"×4" portions with a #9 Meyer bar. These barrier coatings were then cured at 125° C. for 30 minutes. In this manner, the OPC layer in each of the examples (except for Example 19 which was a control sample without a barrier layer) was completely enclosed by the aluminum/polyester sheet on one surface, and by the barrier layer on all remaining surfaces.

Each of the enclosed OPC layer samples in Examples 19–23 were immersed in a bath containing 20 grams of Norpar®12 (a toner carrier liquid commercially available from Exxon Corp.) for 96 hours at room temperature. After 96 hours, the Norpar®12 carrier liquid was removed from the bath and analyzed by a Perkin-Elmer UV Spectrometer at 380 nm to determine the concentration of UV dye contained in the carrier liquid. Any UV dye found in the Norpar®12 had to come from the UV dye contained with the enclosed OPC layer. Moreover, since aluminum is impervious to Norpar®12, any dye in the carrier fluid had to have been extracted from the OPC layer through the barrier layer. Thus, the concentration of UV dye found in the Norpar®12 carrier liquid provided a relative measurement of the extent of penetration of the different barrier layers by the Norpar®12. In this manner, the effectiveness of the barrier layers set forth in Table 3 in preventing carrier fluid from contacting the OPC layer could be compared.

The results of the extraction study are summarized below in Table 3. The 380 nm UV absorbance value shown in Table 3 is directly proportional to the concentration of extracted UV dye in the Norpar®12 carrier liquid. Thus, the larger the absorbance value, the poorer was the performance of the corresponding barrier layer in providing a barrier to carrier liquid infiltration.

TABLE 3

| Ex. | | chemistry | UV absorbance at 380 nm | comment |
|---|---|---|---|---|
| 19 | OPC + UV dye | no barrier | >2.5 | poor |
| 20 | Ex. 5/OPC + dye | silane | ~0.75 | fair~poor |
| 21 | Ex. 9/OPC + dye | silica + silane | ~0.65 | fair~poor |
| 22 | Ex. 13/OPC + dye | silica + organic polymer | ~0.1–0.25 | good |
| 23 | Ex. 15/OPC + dye | organic polymer | ~0.05 | excellent |

Example 19, a control sample with no barrier, had the highest Norpar®12 infiltration as indicated by the greater than 2.5 UV absorbance value.

Example 20, which is representative of the barrier layers of Examples 1–5 (comparative examples having a silane only), includes the barrier layer of Example 5 enclosing an OPC layer with UV dye therein. As indicated by the 0.75 UV absorbance value, this barrier layer provides protection to the OPC from carrier liquid contact.

Example 21, which is representative of the barrier layers of Examples 6–9 (comparative examples consisting of silica and silane), includes the barrier layer of Example 9 enclosing an OPC layer with UV dye therein. The carrier liquid protection provided to the OPC from this barrier better is only slightly better than that provided by the silane barrier layer in Example 20, but is still poor in comparison to Examples 22 and 23.

Example 22, representative of the silica/organic polymer composite barrier layers of the present invention, includes the barrier layer of Example 13 (silica and PVA/Gantrez™ organic polymer) enclosing an OPC layer having UV dye therein. At a UV absorbance value of 0.1–0.25, this barrier layer provides good protection from carrier liquid infiltration. As seen, such protection is better than that provided by the silane or silica/silane barrier layers of Examples 20 and 21.

The barrier layer in Example 23, containing an organic polymer only (Example 15), provides the best carrier liquid protection. However, as demonstrated in Table 2, such a barrier layer provides no protection from corona-produced charge, ozone, or ionized particle contact. The barrier layer of Example 22, on the other hand, provides excellent charge, ozone, and ionized particle protection. Thus, from a standpoint of providing all around protection to the OPC, the silica/organic polymer composite barrier layer of the present invention is superior to any other barrier layer formulation.

What is claimed is:

1. A photoconductor element for use in electrophotographic imaging, comprising:

a support;

a photoconductive layer coated on said support;

a barrier layer coated on said photoconductive layer, said barrier layer comprising an organic polymer and silica, said polymer and said silica being present in said barrier layer at a silica to polymer weight ratio ranging from 9:1 to 1:1; and a release layer topcoat coated on said barrier layer.

2. The photoconductor element of claim 1 wherein said polymer and said silica are present in said barrier layer at a silica to polymer weight ratio ranging from 3:1 to 1.2:1.

3. The photoconductor element of claim 2 wherein said polymer and said silica are present in said barrier layer at a silica to polymer weight ratio ranging from 2.5:1 to 1.5:1.

4. The photoconductor element of claim 1 wherein said barrier layer is between 0.1 and 5 microns in thickness.

5. The photoconductor element of claim 1 wherein said photoconductive layer is an organic photoconductive layer.

6. A photoconductor element for use in electrophotographic imaging, comprising:

a support;

a photoconductive layer coated on said support;

a barrier layer coated on said photoconductive layer, said barrier layer consisting essentially of an organic polymer and silica, said polymer and said silica being present in said barrier layer at a silica to polymer weight ratio ranging from 9:1 to 1:1; and release layer topcoat coated on said barrier layer.

7. The photoconductor element of claim 6 wherein said polymer and said silica are present in said barrier layer at a silica to polymer weight ratio ranging from 3:1 to 1.2:1.

8. The photoconductor element of claim 7 wherein said polymer and said silica are present in said barrier layer at a silica to polymer weight ratio ranging from 2.5:1 to 1.5:1.

9. The photoconductor element of claim 6 wherein said barrier layer is between 0.1 and 5 microns in thickness.

10. The photoconductor element of claim 6 wherein said photoconductive layer is an organic photoconductive layer.

* * * * *

UNITED STATES PATENT AND TRADEMARK OFFICE

CERTIFICATE OF CORRECTION

PATENT NO. : 6,001,522
DATED : December 14, 1999
INVENTOR(S) : Woo et al.

It is certified that error appears in the above-identified patent and that said Letters Patent is hereby corrected as shown below:

Title page,
OTHER PUBLICATIONS, please insert:

-- FOREIGN PATENT DOCUMENTS

| | | |
|---|---|---|
| JP 02151870 | 06/1990 | Japan |
| JP 63280260 | 11/1988 | Japan |
| JP 04037765 | 02/1992 | Japan |
| JP 01134464 | 05/1989 | Japan -- |

Signed and Sealed this

Second Day of April, 2002

*Attest:*

*Attesting Officer*

JAMES E. ROGAN
*Director of the United States Patent and Trademark Office*